US007559882B2

(12) United States Patent
Chou

(10) Patent No.: US 7,559,882 B2
(45) Date of Patent: Jul. 14, 2009

(54) SWINGING WAIST-TWISTING FITNESS EQUIPMENT

(75) Inventor: Ming-Fu Chou, Taichung (TW)

(73) Assignee: King I Tech Corporation, Taichung (TW)

( * ) Notice: Subject to any disclaimer, the term of this patent is extended or adjusted under 35 U.S.C. 154(b) by 0 days.

(21) Appl. No.: 11/939,421

(22) Filed: Nov. 13, 2007

(65) Prior Publication Data

US 2009/0124472 A1 May 14, 2009

(51) Int. Cl.
*A63B 71/00* (2006.01)

(52) U.S. Cl. ..... 482/148; 482/51

(58) Field of Classification Search ..... 482/146–148, 482/70–71, 51
See application file for complete search history.

(56) References Cited

U.S. PATENT DOCUMENTS

| | | | | |
|---|---|---|---|---|
| 3,936,047 | A * | 2/1976 | Brandt et al. | 482/146 |
| 7,112,162 | B2 * | 9/2006 | Greenland | 482/94 |
| 7,134,989 | B2 * | 11/2006 | Liao | 482/142 |
| 2007/0037667 | A1 * | 2/2007 | Gordon | 482/51 |

* cited by examiner

*Primary Examiner*—Lori Amerson
(74) *Attorney, Agent, or Firm*—Egbert Law Offices PLLC

(57) ABSTRACT

A swinging waist-twisting fitness equipment has a main frame with a stand and a vertical rack, a hand rest on the vertical rack, a vertically swinging frame on the vertical rack, and a rotary support pad mounted onto a swinging portion of the vertically swinging frame. The vertically swinging frame has an upper end linked to a vertical rack via a pivot portion and a lower end forming the swinging portion. The rotary support pad is mounted onto the swinging portion so as to cause horizontal or rotary motion thereof. The vertically swinging frame is a U-shaped rod.

5 Claims, 7 Drawing Sheets

SWINGING WAIST-TWISTING FITNESS EQUIPMENT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to fitness equipment, and more particularly to innovative equipment which enables swinging and rotary motion for physical fitness.

2. Description of Related Art Including Information Disclosed Under 37 CFR 1.97 and 37 CFR 1.98.

Given the fact that many people are very busy with their business and without sufficient time for outdoor activities, an indoor fitness equipment is developed for indoor sports and physical exercise.

With continuous technological innovation and breakthroughs in this industry, a variety of fitness equipment has already taken shape depending upon their targeted fitness function, such as exercise bikes, steppers, paddling fitness equipments, lifting jacks, treadmills and waist-twisting fitness equipment.

Waist-twisting fitness equipment is typically designed in a manner to provide a rotating disk for standing or riding, and a hand rest for support, enabling the users to conduct waist-twisting movement on the rotating disk. However, since this waist-twisting fitness equipment generates only reciprocating rotary motion, the users may get bored quickly, leading to a poorer effect on sports and amusement.

Subsequently, an improved waist-twisting fitness equipment combining the rotating disk with a curved track seat is developed to generate a curved reciprocating shift during a waist-twisting movement. However, the curved track seat of sufficient length or dimension shall be required since it is mounted onto the base of the fitness equipment. So, the space required for the waist-twisting fitness equipment will increase considerably, leading to more cost of materials, shipping and warehousing as well as inconvenient placement or retraction.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

There is enhanced efficacy of the present invention.

With this swinging waist-twisting fitness equipment, swinging and waist-twisting movement could be provided simultaneously to achieve better physical exercise and amusement, thus enhancing the desire of the users and fitness effect with better applicability.

Owing to the simple structure of the vertically-swinging frame (e.g. a ⊔-shaped frame), no bigger space is required during the swinging process, making it possible to minimize the space in an idle state. As compared to the typical prior art structure with a curved track seat, the swinging waist-twisting fitness equipment of the present invention reduces the manufacturing cost and achieves better economic efficiency for the benefit of the users.

There are improvements brought about by this invention.

Based on the structure of the two side levers with the ⊓-shaped rack and elbow cushion, the user operates the equipment with more stability and comfort when the hand rest is gripped.

Based on the structure of the retractable portion arranged between pivot portion and swinging portion of the vertically-swinging frame, the vertical length of the vertically-swinging frame can change. Then the position of the swinging portion and rotary support pad could be adjusted to fit the stature of different users with better applicability.

Based on the structure of the rotary support pad 40 being tilted, the packaging space of vertically-swinging frame 30 could be further reduced to save shipping and warehousing costs for the benefit of the users.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
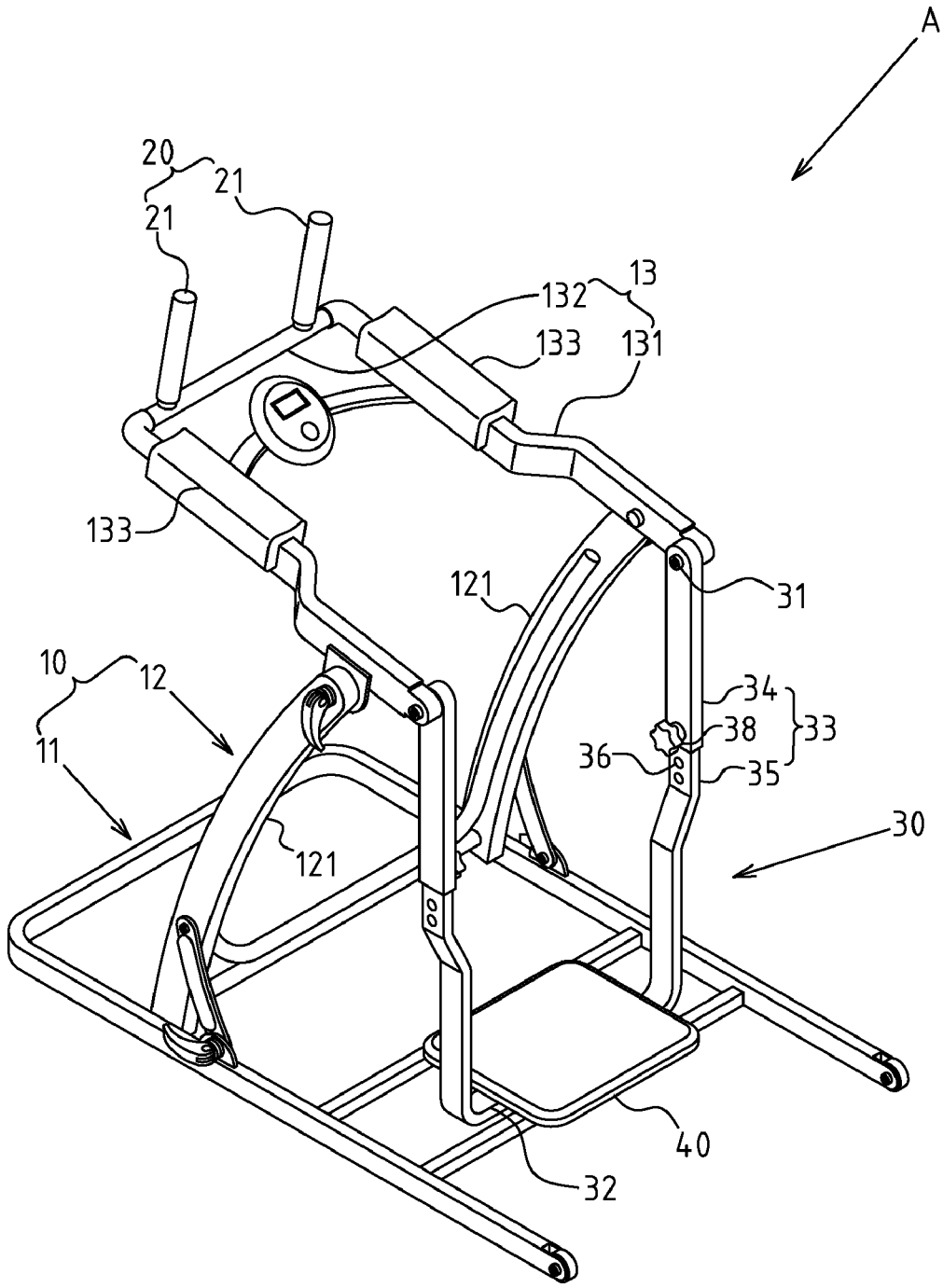
FIG. 1 shows an assembled perspective view of the waist-twisting fitness equipment of the present invention.

FIG. 1 depicts a preferred embodiment of waist-twisting fitness equipment of the present invention. The embodiments are provided only for explanatory purposes with respect to the patent claims.

The swinging waist-twisting fitness equipment A comprises a main frame 10, which is connected to a stand 11 and a vertical rack 12 mounted on the stand 11. The stand 11 of this preferred embodiment is composed of a horizontal ⊓-shaped bar and several connecting rods.

A hand rest 20 is located at a preset position of vertical rack 12 of the main frame 10.

A vertically-swinging frame 30 is assembled onto the vertical rack 12 of main frame 10. The upper end of the vertically-swinging frame 30 is linked to vertical rack 12 via a pivot portion 31, and the lower end is defined to form a swinging portion 32.

Figure 2:
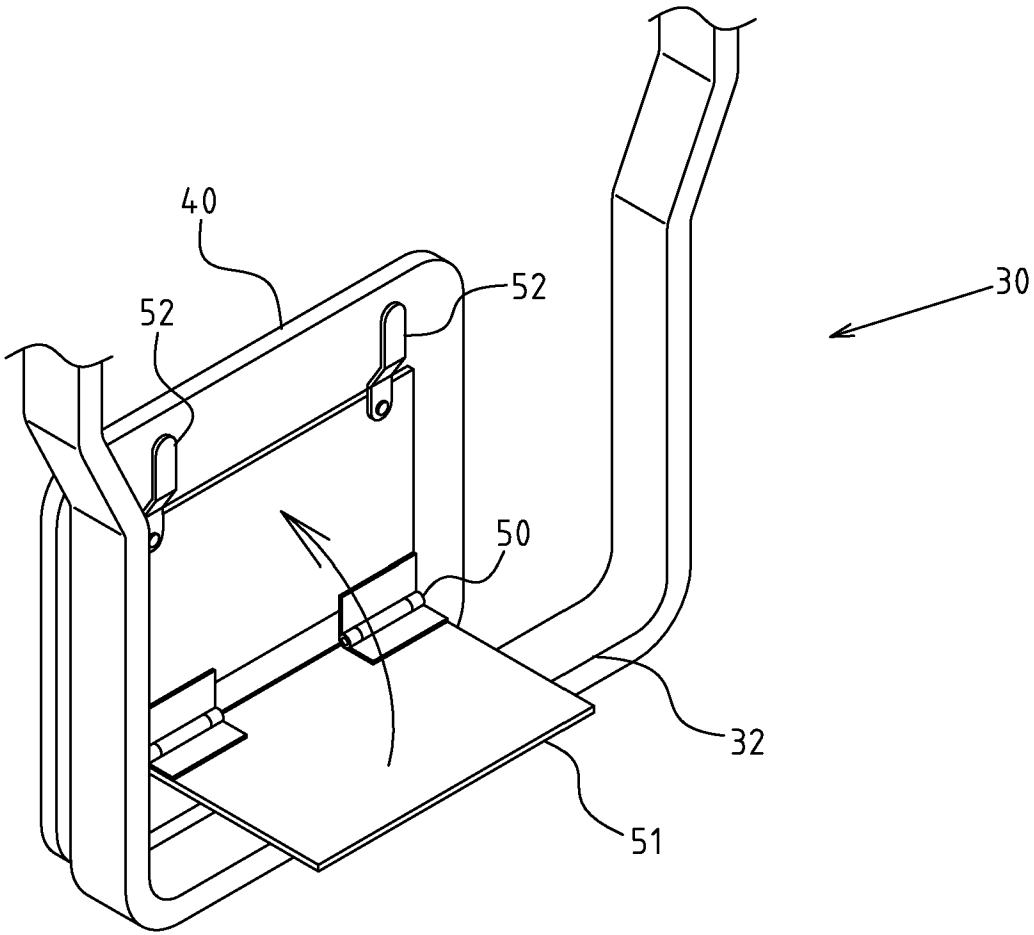
FIG. 2 shows a perspective of the rotary support pad of the present invention which is in a tilting state.

A rotary support pad 40 is mounted onto swinging portion 32 of vertically-swinging frame 30 for horizontal or rotary motion (or 360° rotation or rotation within preset angle). Referring also to FIG. 2, the bottom of the rotary support pad 40 is coupled to a baseplate 51 via pin joint 50, such that the rotary support pad 40 can be tilted. A control element 52 is arranged between the tilting end of rotary support pad 40 and the baseplate 51 to switch the positioning or tilting state of the rotary support pad 40. It is possible to reduce space when the rotary support pad 40 is tilted, thereby saving the packing materials or accommodating space of vertically-swinging frame 30.

The vertical rack 12 of the main frame 10 comprises two vertical hack levers 121 arranged at intervals. A ⊓-shaped rack 13 extending towards the front end of the main frame 10 is assembled on the top of two vertical hack levers 121. The ⊓-shaped rack 13 is used to define two side levers 131 and a front lever 132, so that the top end of the vertically-swinging frame 30 is assembled at the rear end of two side levers 131. The hand rest 20 is composed of two vertical rods 21, which are arranged at intervals on the top of the front lever 132. Moreover, the two side levers 131 of ⊓-shaped rack 13 are provided with elbow cushion 133. The elbow cushion 133 is made of soft or flexible materials (e.g. rubber, foam), so the elbows of user have stability and comfortable support by the elbow cushion 133 when the user grips said hand rest 20.

Figure 3:
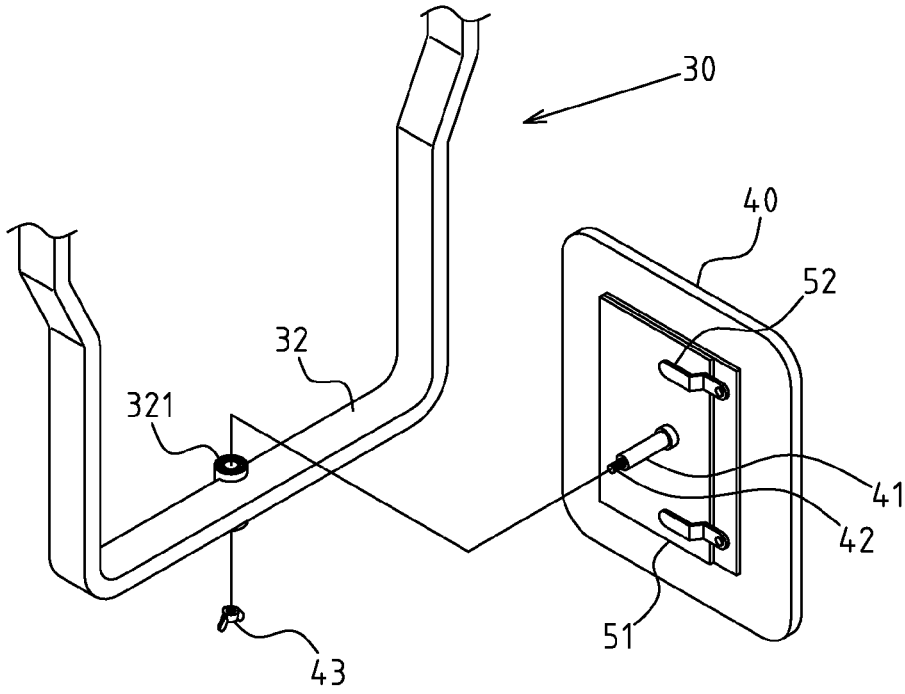
FIG. 3 shows an exploded perspective view of the rotary support pad of the present invention.
Figure 4:
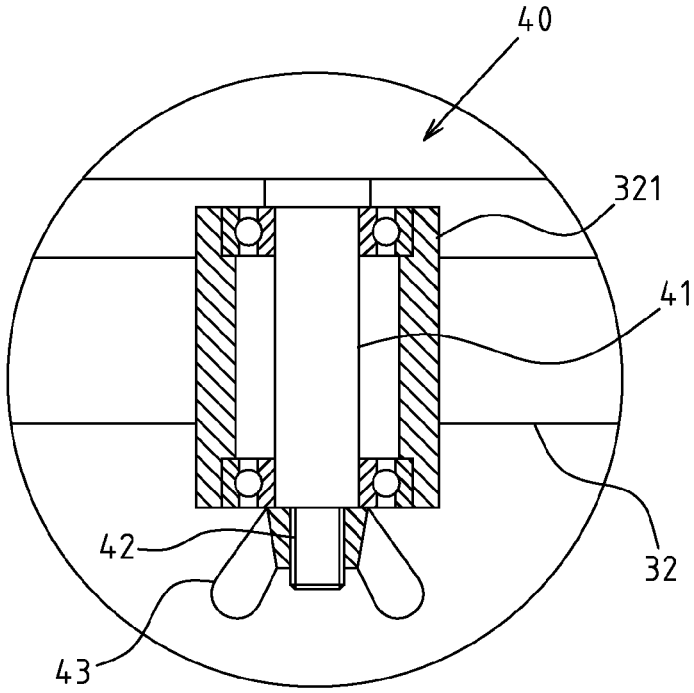
FIG. 4 shows an assembled sectional view of the rotary support pad of the present invention.

The vertically-swinging frame 30 is of a ⊔-shaped rod, so that the lower swinging portion 32 of the vertically-swinging frame 30 is made of horizontal rods at bottom of the ⊔-shaped rod. Referring also to FIGS. 3 and 4, a bearing block 321 is assembled at a middle section of the swinging portion 32. A pivot post 41 protrudes from the bottom of the rotary support pad 40 and penetrates said bearing block 321. A threading portion 42 is located at a bottom of the pivot post 41 for locking a nut 43 (a butterfly nut in this preferred embodiment), so that the assembly state of pivot post 41 and bearing block 321 can be positioned.

Figure 6:
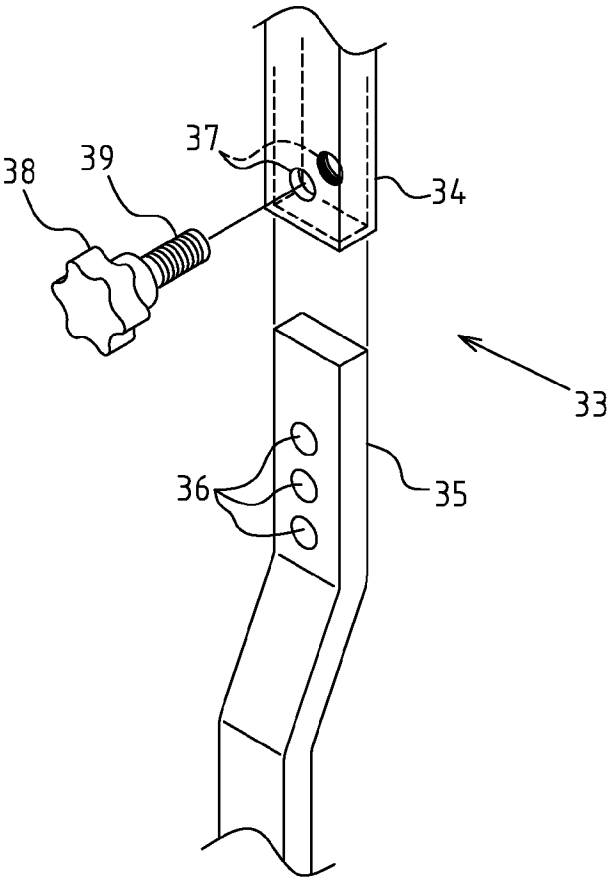
FIG. 6 shows an exploded perspective view of the preferred embodiment of the retractable portion of the present invention.
Figure 5:
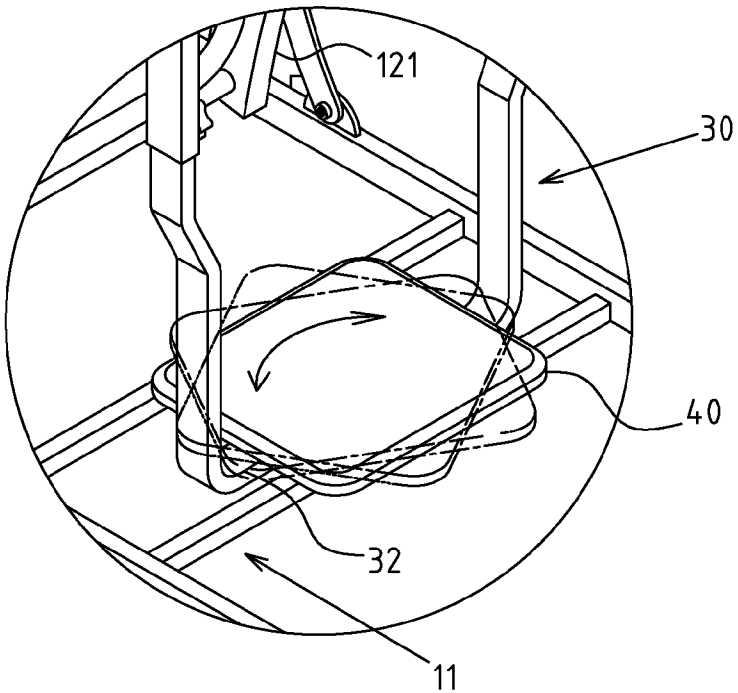
FIG. 5 shows an isolated perspective view of the rotary support pad of the present invention in a rotary state.

A retractable portion 33 is arranged between pivot portion 31 and swinging portion 32 of vertically-swinging frame 30, so that the position of the swinging portion 32 along with rotary support pad 40 could be adjusted. The retractable portion 33 is depicted in FIG. 6, wherein the vertical hack lever between pivot portion 31 and swinging portion 32 of vertically-swinging frame 30 is divided into coupled external tube section 34 and interior rod section 35. The interior rod section 35 is provided with through-holes 36 arranged at intervals, and the external tube section 34 is provided with locating holes 37. A locating button 38 is additionally provided, and a screw portion 39 on the locating button 38 penetrates the corresponding through-hole 36 and locating hole 37. Thus, the vertical length of vertically-swinging frame 30 could be changed, and the position of the swinging portion 32 along with rotary support pad 40 could be adjusted depending upon the stature of the user.

Figure 7:
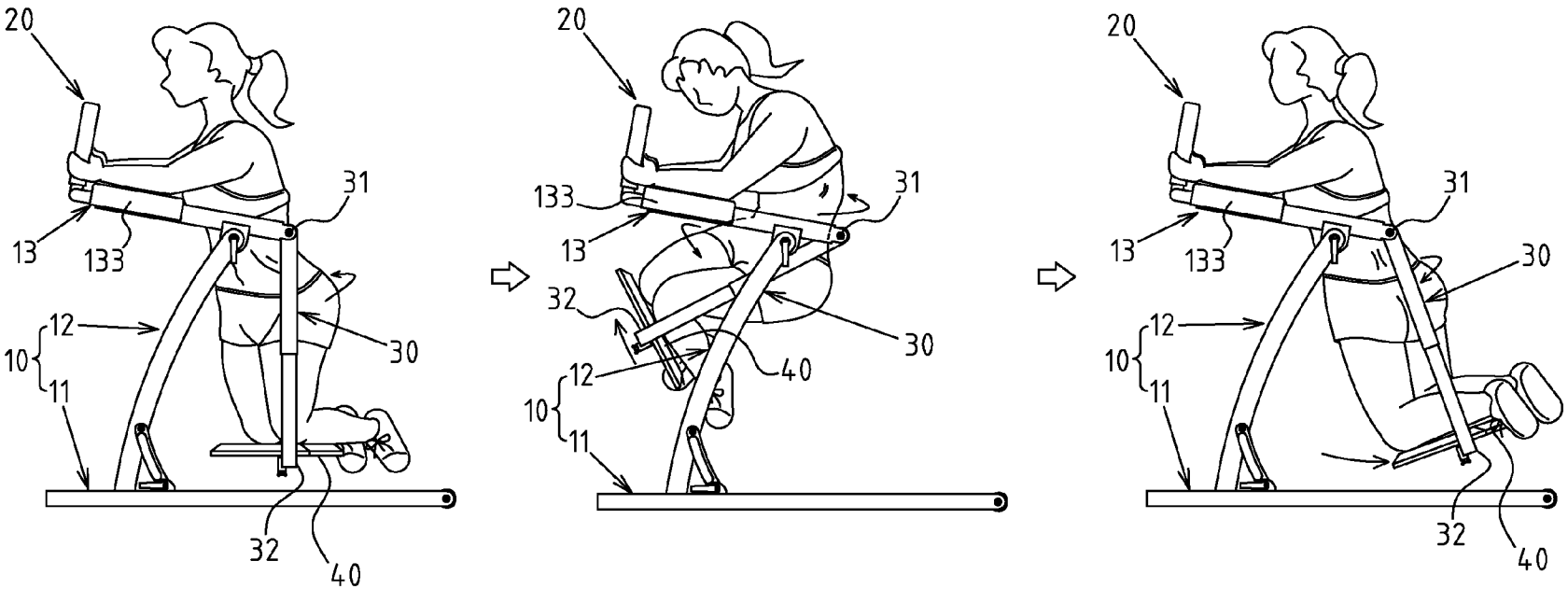
FIG. 7 shows a first series of elevation views of the operation of the waist-twisting fitness equipment of the present invention.
Figure 8:
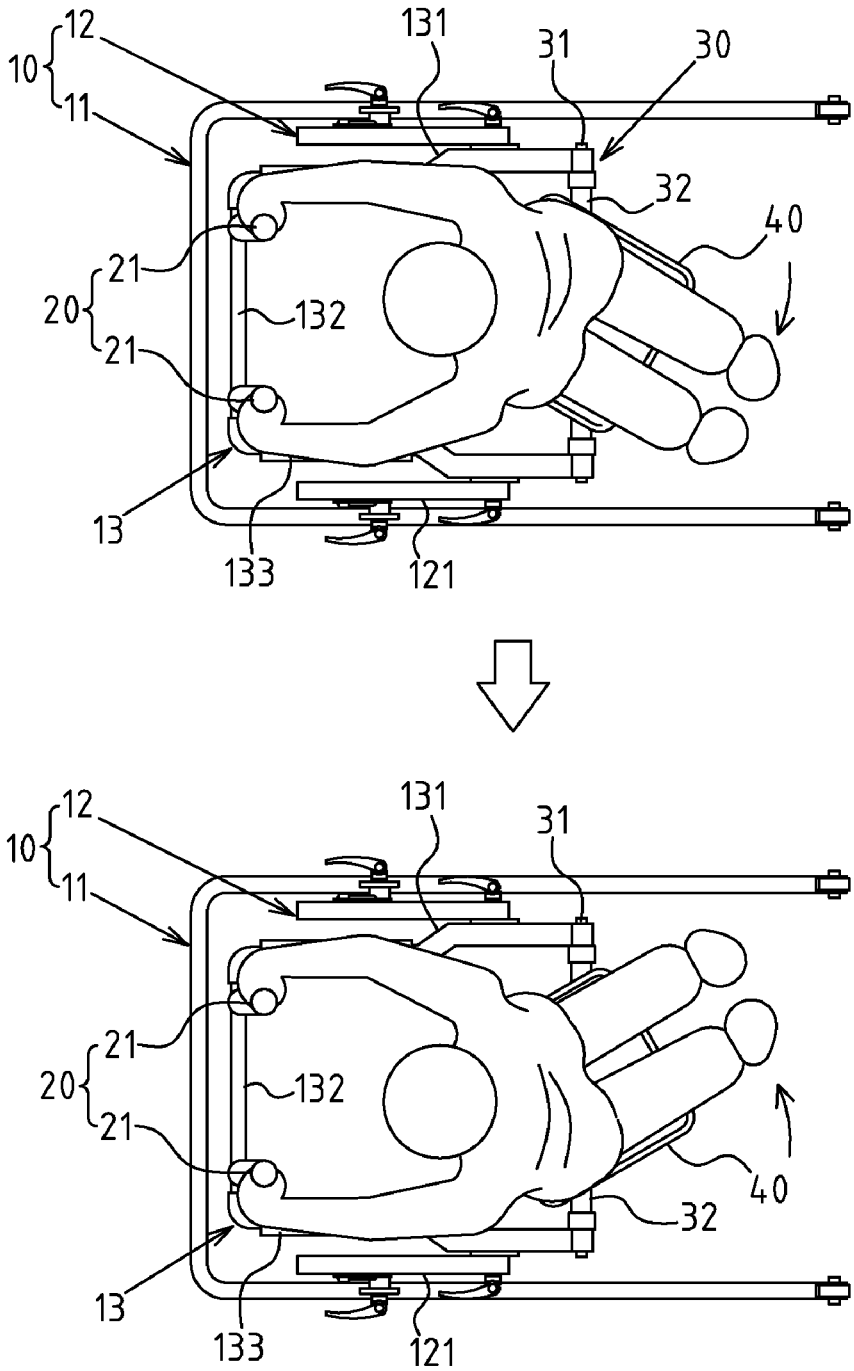
FIG. 8 shows a second series of elevation views of the operation of the waist-twisting fitness equipment of the present invention.

Based upon above-specified structures, the present invention is operated as follows:

FIG. 7 depicts an operating mode of swinging waist-twisting fitness equipment A of the present invention, whereby the user could kneel down on the rotary support pad 40 and grip the hand rest 20 on the vertical rack 12 with elbows lying on the elbow cushion 133. Next, since the lower swinging portion 32 of the vertically-swinging frame 30 generates pendular movement, the user drives the swinging portion 32 to swing forward and backward. In the process of the swinging movement, the rotary support pad 40 generates horizontal or rotary shift, so the waist of the user twists and drives the swinging of knees in a coordinated way (also shown in FIG. 8, which depicts the waist-twisting motion when the swinging frame 30 is at a perpendicular state). During swinging and waist-twisting movement, a balanced state could be obtained by gripping manually the hand rest 20. It is thus learnt that, the swinging waist-twisting fitness equipment A of the present invention could achieve swinging and waist-twisting effect.

Figure 9:
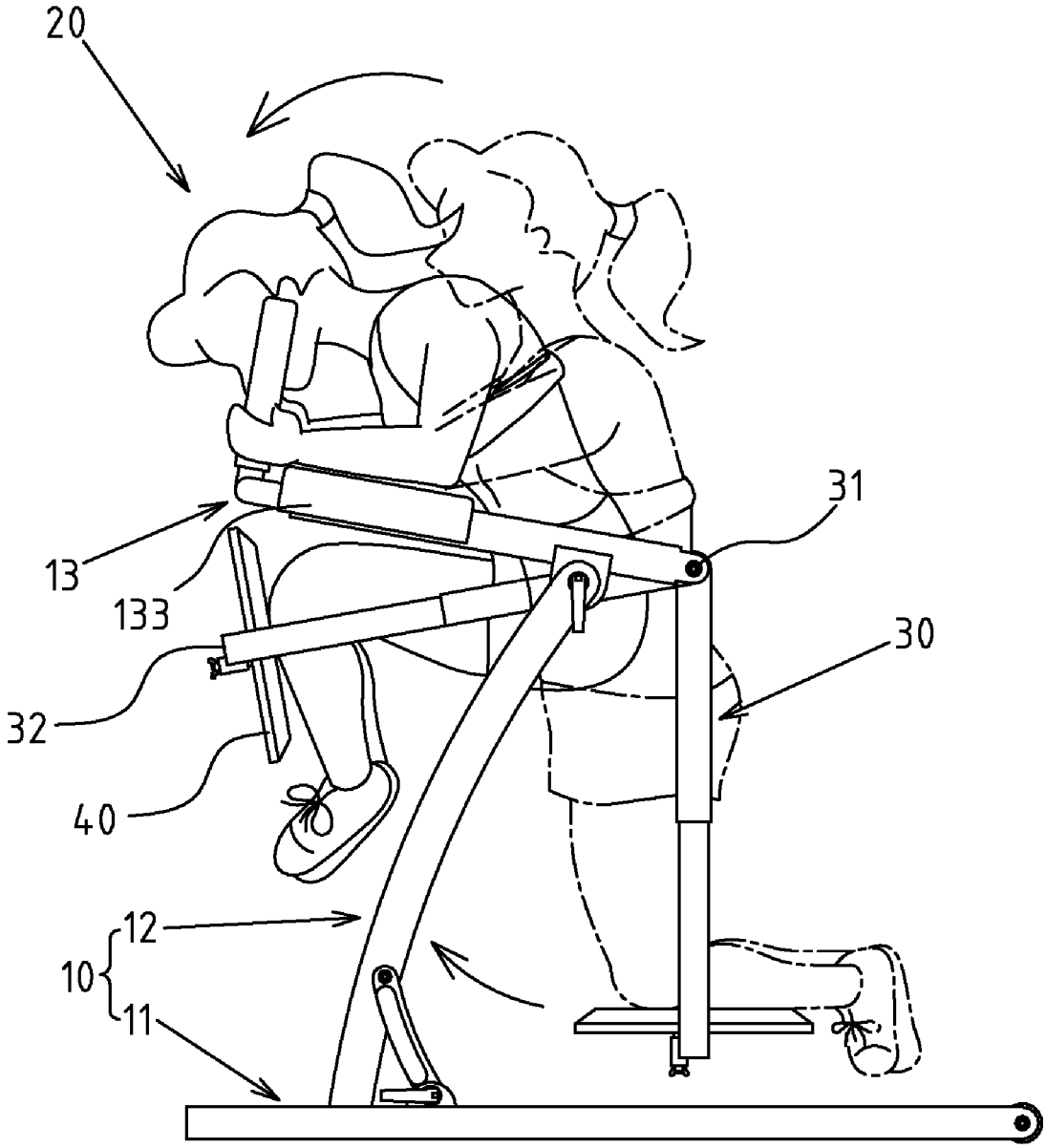
FIG. 9 shows a third series of elevation view of the operation of the waist-twisting fitness equipment of the present invention.

Referring to FIG. 9, when the user operates the swinging waist-twisting fitness equipment A, it is possible to drive the swinging portion 32 to swing forward and backward. When said swinging portion 32 swings forward, the knees and waist of user will be bent to compress the abdomen muscle. When the swinging portion 32 swings backward, the abdomen muscle will be extended, thus leading to a repetitive tensioning and loosening state of the muscle for physical exercise.

I claim:

1. A swinging waist-twisting fitness equipment comprising:

a main frame having a stand and a vertical rack on said stand;

a hand rest positioned at a location on said vertical rack;

a vertically swinging frame assembled onto said vertical rack, said vertically swinging frame having an upper end linked by a pivot portion to said vertical rack, said vertically swinging frame having a lower end that defines a swinging portion; and a rotary support pad mounted onto said swinging portion so as to cause horizontal or rotary motion thereof, said vertically swinging frame being a U-shaped rod, said lower end of said vertically swinging frame having horizontal rods at a bottom of said U-shaped rod, said swinging portion having a bearing block assembled at a middle thereof, said rotary support pad having a pivot post protruding from a bottom thereof and extending into said bearing block, said pivot post having a threaded portion at a bottom thereof, said threaded portion having a nut locked thereonto.

2. The equipment of claim 1, said vertical rack of said main frame comprising:

a pair of vertical hack levers arranged in spaced relationship; and an inverted U-shaped rack extending toward a front end of said main frame, said inverted U-shaped rack assembled on top of said pair of vertical back levers, said inverted U-shaped rack defining a pair of side levers and a front lever, said upper end of said vertically swinging frame assembled at a rear end of said pair of side levers, said hand rest having a pair of vertical rods in spaced relation on a top of said front lever.

3. The equipment of claim 2, said pair of side levers having elbow cushions thereon.

4. The equipment of claim 1, said vertically swinging frame having a retractable portion arranged between said pivot portion and said swinging portion, said retractable portion suitable for adjusting a position of said swinging portion and said rotary support pad.

5. A swinging waist-twisting fitness equipment comprising:

a main frame having a stand and a vertical rack on said stand;

a hand rest positioned at a location on said rack;

a vertically swinging frame assembled onto said vertical rack, said vertically swinging frame having an upper end linked by a pivot portion to said vertical rack, said vertically swinging frame having a lower end that defines a swinging portion; and a rotary support pad mounted onto said swinging portion so as to cause horizontal or rotary motion thereof, said rotary support pad having a bottom coupled by a pin joint to a base plate so as to allow said rotary support pad to tiltable; and a control element positioned between an end of said rotary support pad and said base plate so as to control a positioning of said rotary support pad.

* * * * *